United States Patent [19]

Lübbers

[11] Patent Number: 4,991,510

[45] Date of Patent: Feb. 12, 1991

[54] IMPACT FUSE HAVING FORE-BORE SAFETY

[75] Inventor: Willi Lübbers, Rotenbek, Fed. Rep. of Germany

[73] Assignee: Nico-Pyrotechnik Hanns-Jurgen Diederichs, Fed. Rep. of Germany

[21] Appl. No.: 477,890

[22] PCT Filed: Aug. 14, 1989

[86] PCT No.: PCT/DE89/00533

§ 371 Date: Apr. 13, 1990

§ 102(e) Date: Apr. 13, 1990

[87] PCT Pub. No.: WO90/02309

PCT Pub. Date: Mar. 8, 1990

[30] Foreign Application Priority Data

Aug. 16, 1988 [DE] Fed. Rep. of Germany ..... 3827785

[51] Int. Cl.[5] ..... F42C 1/04; F42C 15/24

[52] U.S. Cl. ..... 102/247; 102/253; 102/272

[58] Field of Search ..... 102/272, 273, 274, 275, 102/247, 222, 481, 253

[56] References Cited

U.S. PATENT DOCUMENTS

| | | | |
|---|---|---|---|
| 190,861 | 5/1877 | Hotchkiss | 102/275 |
| 1,509,329 | 9/1924 | Woodberry | 102/272 |
| 2,595,757 | 5/1952 | Brandt | 102/481 |
| 2,650,541 | 9/1953 | Rosselet | 102/283 |
| 3,576,165 | 4/1971 | Gawlick et al. | 102/258 |
| 3,995,556 | 12/1976 | Lübbers | 102/272 |
| 4,036,145 | 7/1977 | Lübbers | 102/247 |
| 4,487,127 | 12/1984 | Lübbers | 102/272 |
| 4,723,490 | 2/1988 | Sigrist | 102/273 |

FOREIGN PATENT DOCUMENTS

| | | |
|---|---|---|
| 475670 | 9/1947 | Belgium . |
| 2426838 | 1/1976 | Fed. Rep. of Germany . |
| 690879 | 9/1930 | France . |
| 989525 | 9/1951 | France . |

*Primary Examiner*—David H. Brown

*Attorney, Agent, or Firm*—Davis, Bujold & Streck

[57] ABSTRACT

The invention relates to an impact fuse (2) having fore-bore safety for a projectile (1), comprising a percussion needle (3) stationary on the fuse and an impact body (4) containing a percussion cap (5) and supported slidingly in the direction of flight, as well as a race for a blocking ball (23) between the impact body and the inner wall of the projectile casing. Which, upon premature impact on an obstacle, is jammed in its race (22) between a shoulder (18, 19, 20) on the inner wall of the casing and a ramp (17) of a groove (14, 15, 16) on the impact body (4), thereby preventing detonation. In order to allow for adjustment of predefined distances for the fore-bore safety, the invention proposes giving the race (22) for the blocking ball (23) a stepped design so that the blocking ball (23) can be jammed at several places within the fuse (2) between shoulders (18, 19, 20) and ramps (17) of different grooves (14, 15, 16).

5 Claims, 2 Drawing Sheets

IMPACT FUSE HAVING FORE-BORE SAFETY

The present invention relates to an impact fuse having fore-bore safety.

Such a fuse is known from German patent no. 24 26 838. A percussion needle stationary on the fuse has associated therewith an impact body directed slidingly in the projectile's direction of flight and bearing a percussion cap. This impact body is locked in the transport and firing position with the aid of locking balls in the fuse casing which are moved out of their locking position after firing and thus release the impact body. When the projectile hits a target, the impact body slides toward the percussion needle due to its inertia, thereby detonating the percussion cap. In order to prevent unintentional detonation in the immediate vicinity of the firing point, the impact body contains a groove open toward the front in the direction of flight with at least one blocking ball supported therein. Opposite the open end of the groove there is a shoulder stationary on the fuse with a receiving space for the ball adjacent thereto. During the acceleration upon firing of the projectile, the blocking ball is pressed onto the bottom of the groove. After the impact body is released when the projectile emerges from the projector, the firing acceleration ends. The projectile is now slowed down by air resistance. The ball, which is not subject to such air resistance, moves in its race toward the shoulder, due to the effect of the initial acceleration, and then runs into a receiving space. The length of time required by the ball for this process can be adjusted by appropriate dimensioning of the race. Should the projectile hit an obstacle within the range of the fore-bore safety, the impact body shoots toward the percussion needle but the blocking ball is jammed between the impact body and the shoulder, thereby preventing detonation. Detonation can take place only when the blocking ball has finally run into its receiving space.

The distance of fore-bore safety that can be achieved with this impact fuse is in the range of one meter or slightly more. This distance can be adjusted by lengthening the race, but this can only be done very imprecisely due to the friction of the ball between the groove and the cylinder housing.

The invention is based o the problem of stating an impact fuse of the type in question which allows for a greater distance of fore-bore safety and for reliable adjustment thereof to predefined values.

This problem is solved according to the invention by the features stated in the characterizing part of claim 1.

The race of the blocking all thus has a stepped design, the ball being reliably turned around on the steps so that the distances of fore-bore safety can be defined. Due to the blocking ball being turned around on the individual shoulders, one can determine very precisely the time lapse of the ball movement out of the starting position as far as the receiving space.

Figure 1:
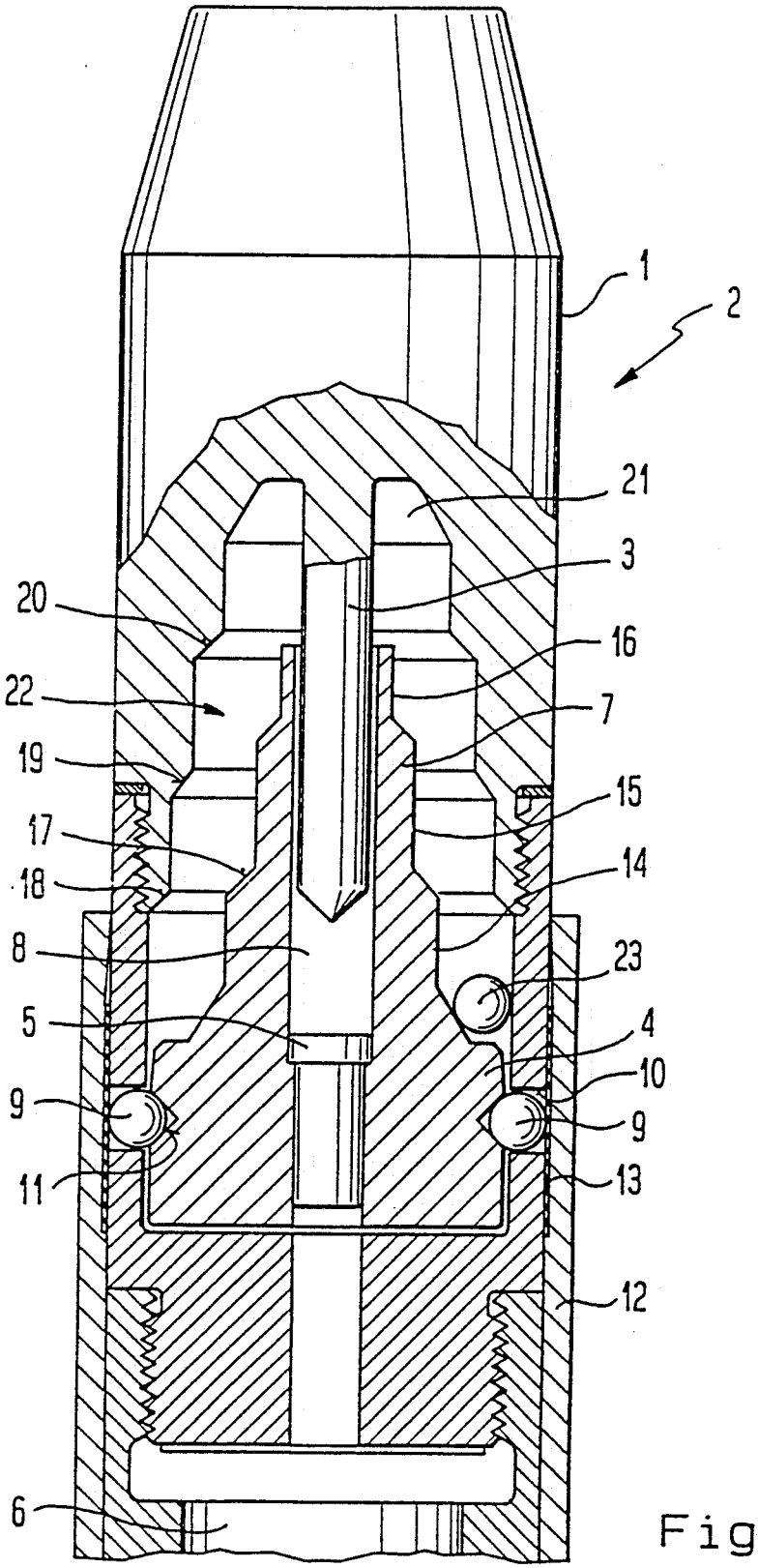
Figure 2:
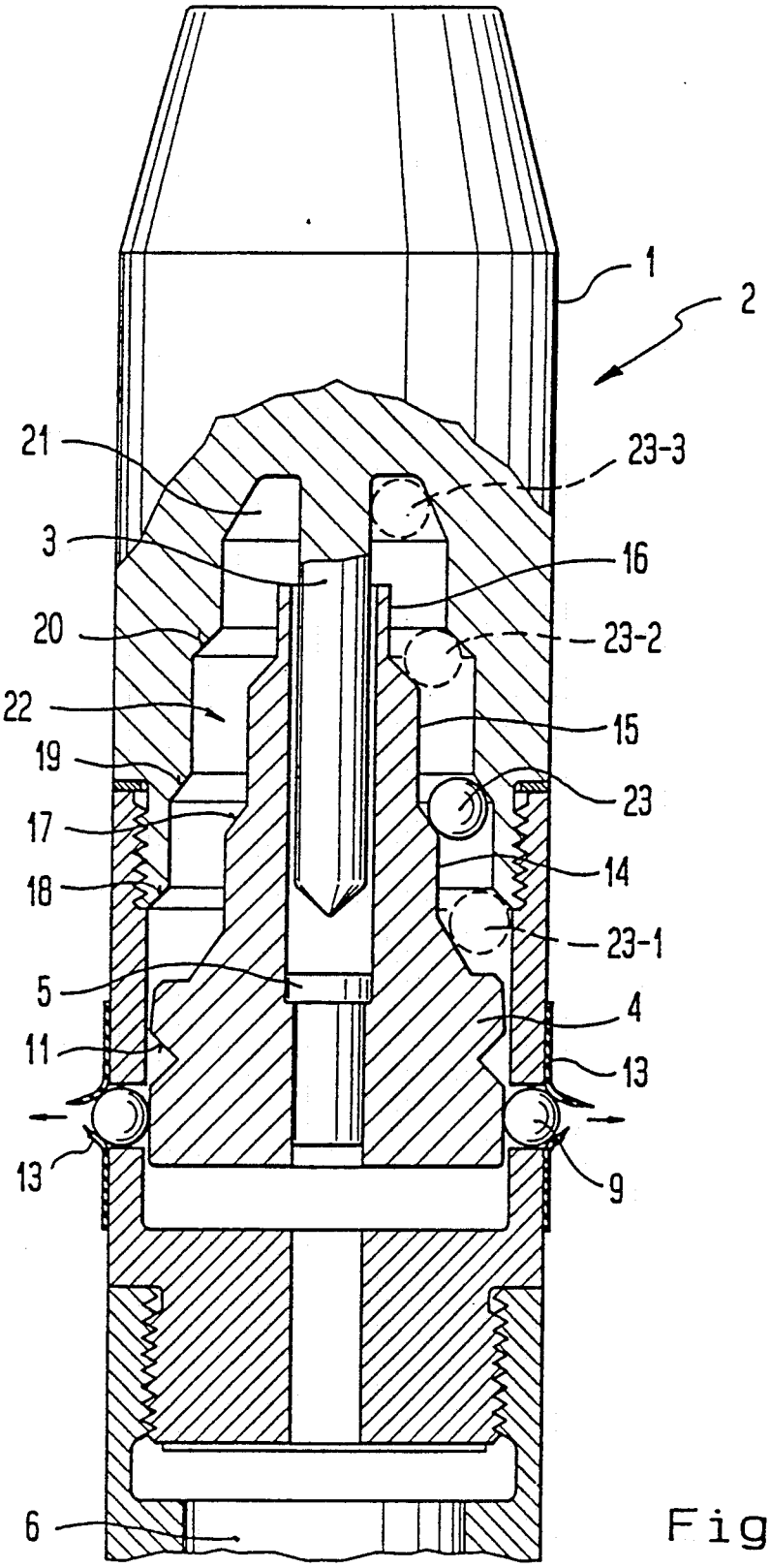

Further embodiments of the invention can be found in the subclaims. The invention shall be explained in more detail in an exemplary embodiment with reference to the drawing, in which FIG. 1 shows a cross-section of a projectile nose with an inventive impact fuse:

FIG. 2 shows a cross-section of the projectile nose in a blocked position of the impact fuse.

An impact fuse 2 is disposed in the nose of a mortar practice cartridge 1 and has a percussion needle 3 stationary on the fuse and an impact body 1 containing a percussion cap 5 for detonating a smoke detonation 6 roughly sketched. Impact body 4 is slidingly mounted in the projectile casing surrounding it and is provided with a head 7 tapering forward in steps. This head 7 has a central bore 8 into which percussion needle 3 fits. Impact body 4 is held in its area adjacent the projectile casing with two locking balls 9 which engage bores 10 penetrating the casing, and depressions 11 on impact body 4. Projectile 1 is surrounded by a cartridge case 12, whereby an easily destructible cover 13, e.g. a plastic, paper or metal sheet, is situated between cartridge case 12 and locking balls 9.

Head 7 of impact body 4 has annular grooves 14, 15 and 16 adjacent one other and separated by ramps 17. The inner wall of the projectile casing is formed approximately parallel to this step structure, an inwardly pointing shoulder 18 being provided at the open end of first annular groove 14, a further shoulder 19 at the open end of second annular groove 15 and a shoulder 20 at the open end of annular groove 16. Adjacent this shoulder 20 is a receiving space 21. The free space between head 7 of the impact body and the inner projectile wall forms a race 22 for a locking ball 23.

When mortar practice cartridge 1 is fired, cartridge case 12 remains in the firing means but does not damage cover 13. Locking ball 23 is pressed against the bottom of first groove 14, as shown in FIG. 1. When the projectile has left the mortar, the air resistance has a braking effect on the projectile but not on blocking ball 23. The latter travels in its race 22 toward receiving space 21 during the flight of the projectile, even in vertical flight. Blocking ball 23 reaches receiving space 21 after the projectile has covered about 15 m. When the projectile thereafter hits a target, impact body 4 rushes forward on impact, thereby pressing the two locking balls 9 out of their recesses 11 and flinging them into the air by destroying cover 13. Impact body 4, that is now free, hits the tip of percussion needle 3 with the percussion cap, so that the detonating jet can ignite smoke detonator 2 backwards.

However, if projectile 1 hits an obstacle during the time in which blocking ball 23 is traveling through its race 22, impact body 4 also shoots forward but blocking ball 23 is jammed between a shoulder on the inner wall of the casing and a ramp 17 on head 7 of the impact body. FIG. 2 displays a blocking position of the ball between second shoulder 19 and ramp 17 between first annular grooves 14 and 15. The position of the annular groves and shoulders can be selected, for example, in such a way that such a blocking position occurs when the projectile hits an obstacle at a distance of about 5 to 8 m before the muzzle of the mortar. Number 23-1 indicates a blocking position of the ball between first shoulder 18 and the ramp of groove 14, which takes effect at a distance of about 1 m before the muzzle. The blocking position of the ball shown by the broken line at 23-2 takes effect at a distance of about 8 to 12 m before the muzzle of the mortar. Detonation is possible only when the blocking ball is located in receiving space 21, i.e. after a flight of over 12 m, which is marked by 23-3 in FIG. 2.

What is claimed is:

1. An impact fuse having fore-bore safety for a projectile, comprising a percussion needle stationary on the fuse, an impact body containing a percussion cap and supported slidingly in the projectile's direction of flight, and a race for a blocking ball between the impact body and the inner wall of the fuse casing, which is limited by a groove in the impact body that is open toward the front in the projectile's direction of flight, the inner wall of the fuse casing and a shoulder opposite the open end of the groove in the projectile's direction of flight, as well as by a receiving space for the blocking ball adjacent thereto, characterized in that the race (22) for the blocking ball (23) has a plurality of adjacent steps (14, 15, 16) in the direction of flight of the projectile (1).

2. The impact fuse of claim 1, characterized in that the groove of the impact body (4) for the blocking ball has in the direction of flight a plurality of adjacent grooves (14, 15, 16) separated by steps (17) and having associated therewith shoulders (18, 19, 20) also disposed in steps on the projectile casing.

3. The impact fuse of claim 1, characterized in that the race (22) for the blocking ball (23) is limited on the impact body (4) by a plurality of stepped annular grooves (14, 15, 16).

4. The impact fuse of claim 1 characterized in that the impact body (4) tapers forward in a plurality of steps (14, 15, 16) in the direction of flight of the projectile (1).

5. The impact fuse of claim 1, characterized in that the impact body (4) has a central bore (8) which contains the percussion needle (3).

* * * * *